US008376807B2

(12) United States Patent
Fogarty

(10) Patent No.: US 8,376,807 B2
(45) Date of Patent: Feb. 19, 2013

(54) TOY WITH AN ILLUMINATED PART

(76) Inventor: Michael Fogarty, Pawtuckef, RI (US)

( * ) Notice: Subject to any disclaimer, the term of this patent is extended or adjusted under 35 U.S.C. 154(b) by 0 days.

(21) Appl. No.: 13/161,557

(22) Filed: Jun. 16, 2011

(65) Prior Publication Data

US 2012/0322343 A1 Dec. 20, 2012

(51) Int. Cl.
*A63H 33/26* (2006.01)
*A63H 3/02* (2006.01)
*A63H 33/04* (2006.01)

(52) U.S. Cl. ..... 446/485; 446/369; 446/91

(58) Field of Classification Search ..... 446/91, 446/130, 175, 484, 485, 491, 369
See application file for complete search history.

(56) References Cited

U.S. PATENT DOCUMENTS 2,310,037 A * 2/1943 Reno ..... 446/379
3,119,563 A * 1/1964 Ruffman ..... 362/200
3,375,604 A * 4/1968 Alonso ..... 446/92
3,696,548 A * 10/1972 Teller ..... 446/91
3,945,139 A * 3/1976 Miller ..... 40/541
4,298,915 A * 11/1981 Goldfarb et al. ..... 362/124
4,464,861 A * 8/1984 Fogarty et al. ..... 446/370
4,836,823 A * 6/1989 Laven ..... 446/485
4,915,666 A * 4/1990 Maleyko ..... 446/242
5,147,129 A * 9/1992 Ku ..... 362/106
5,207,011 A * 5/1993 Coulthard ..... 40/594
5,267,886 A * 12/1993 Wood et al. ..... 446/175
5,445,552 A * 8/1995 Hine ..... 446/477
5,454,181 A * 10/1995 Rothman et al. ..... 40/564
5,456,625 A * 10/1995 Dumond ..... 446/268
5,466,181 A * 11/1995 Bennett et al. ..... 446/297
6,142,846 A * 11/2000 Ojakaar ..... 446/72
6,524,159 B1 * 2/2003 Kawarizadeh ..... 446/397
7,291,052 B2 * 11/2007 Ellman et al. ..... 446/100
7,520,633 B2 * 4/2009 Hornsby et al. ..... 362/231
7,588,478 B2 * 9/2009 Lashinsky ..... 446/484
7,825,346 B2 * 11/2010 Chu ..... 200/511
7,950,117 B2 * 5/2011 Elhaj ..... 27/1
2003/0148700 A1 * 8/2003 Arlinsky et al. ..... 446/91

* cited by examiner

*Primary Examiner* — Gene Kim
*Assistant Examiner* — Alyssa Hylinski
(74) *Attorney, Agent, or Firm* — Barlow, Josephs & Holmes, Ltd.

(57) ABSTRACT

A toy, such as a teddy bear, pair of hand puppets, or other amusement device wherein an electrical circuit is actuated through the connection of two separate halves of a wired shape, such as a heart, moon, star, light bulb or other form, causing said shape to glow via lights, with aforementioned halves held together via a set of neodymium magnets. When the halves are separated, at least one pair of electrical contacts is disconnected, and therefore, the electrical circuit is incomplete such that the toy does not glow. When the halves are mated or otherwise joined, the at least one pair of electrical contacts come into connection with one another and the electrical circuit is completed, causing the lights within the wired shape to glow.

11 Claims, 7 Drawing Sheets

TOY WITH AN ILLUMINATED PART

NOTICE OF COPYRIGHT PROTECTION

A portion of the disclosure of this patent document and its figures contain material subject to copyright protection. The copyright owner has no objection to the facsimile reproduction by anyone of the patent document or the patent disclosure, but otherwise reserves all copyrights whatsoever.

BACKGROUND

The present invention relates generally to amusement devices, and more particularly to illuminating toys.

Conventional illuminated toys function via an on/off switch which controls the internal electrical circuit powering the lights. This knob pushes one of two contacts toward the other, thus completing the electrical circuit. While this system is functional, it does not further the amusement factor of the device, nor does it inherently suit the purpose of the device. The present invention provides a functional means of powering the device that also provides additional amusement.

SUMMARY

The present invention is a toy, such as a stuffed animal, pair of hand puppets, or other amusement device that includes an electrical circuit, wherein the electrical circuit is actuated through the connection of two separate halves of a wired shape, such as a heart, moon, star, light bulb or other form, that causes the shape to glow or otherwise illuminate. When the halves are separated, at least one pair of electrical contacts is disconnected, and therefore, the electrical circuit is incomplete such that the wired shape of the toy does not glow. When the halves are mated or otherwise joined, such as held together by mated neodymium magnets, the electrical contacts come into connection with one another and the electrical circuit is completed, causing the lights within the wired shape to glow.

In an exemplary embodiment, a toy such as a plush stuffed teddy bear is internally wired with an electrical circuit that leads, through two or more parts that can be mated or placed into contact to illuminate the two or more parts or a portion of the two or more parts. For example, a stuffed animal with two hands, each hand holding half of a heart-shaped object such that when the two halves of the heart-shaped object are aligned and mated, the entire heart or a portion of the heart is illuminated. According to some of the embodiments, the device includes LED lights of the electrical circuit that are connected in series. The illuminated part is in two distinct halves which, when joined together as though held that way by the stuffed animal, complete the internal electrical circuit to power the LED lights. Still further, two (2) sets of neodymium magnets or equivalent means are used to hold the two halves together once they are mated to maintain both the electrical circuit and the illuminated part. When the halves are pulled apart beyond the magnets' grasp, the electrical circuit is disconnected and the lights are turned off. As one of ordinary skill in the art appreciates, alternate means of holding the two halves of parts that are mated may include snaps, hook and loop, clasps, and other mechanisms.

In another exemplary embodiment, a teddy bear is internally wired with another electrical circuit that leads, through the teddy bear's hands into an illuminated part, such as a heart wired with a plurality of LED lights. All the other functionalities of the illuminated part are the same as the above example, except that the plurality of LED lights are connected in parallel and the internal electrical circuit has one additional electrical contact. And, as one of ordinary skill appreciates alternate designs may be used in the circuitry of the two or more pieces that are mated together to complete the electrical circuit and illuminate a portion of the device.

The foregoing generally discloses the features and technical advantages of the present invention so that the detailed description that follows may be better understood. Additional features and advantages of the invention will be described hereinafter which form the subject of the claims of the invention. It should be appreciated by those skilled in the art that the conception and the specific embodiments disclosed may be readily used as a basis for modifying or designing other structures for carrying out the same purposes of the present invention. It should also be realized by those skilled in the art that such equivalent constructions do not depart from the spirit and scope of the invention as set forth in the appended claims.

DESCRIPTION OF THE DRAWINGS

The accompanying drawings, which are incorporated in and form a part of the specification, illustrate embodiments of the present invention, and, together with the description, serve to better explain the principles of the invention. It is to be noted that the drawings illustrate only typical embodiments of the invention and are therefore not to be considered limiting of its scope, for the invention will admit to other equally effective embodiments.

DESCRIPTION

This invention now will be described more fully hereinafter with reference to the accompanying drawings, in which exemplary embodiments are shown. This invention may, however, be embodied in many different forms and should not be construed as limited to the embodiments set forth herein. Moreover, all statements herein reciting embodiments of the invention, as well as specific examples thereof, are intended to encompass both structural and functional equivalents thereof. Additionally, it is intended that such equivalents include both currently known equivalents as well as equivalents developed in the future (i.e., any elements developed that perform the same function, regardless of structure).

Thus, for example, it will be appreciated by those of ordinary skill in the art that the diagrams, schematics, illustrations, and the like represent conceptual views or perspective views illustrating some of this invention. The functions of the various elements shown in the figures may vary in shape, attachment, size, and other physical features. Those of ordinary skill in the art further understand that the exemplary systems, and/or methods described herein are for illustrative purposes and, thus, are not intended to be limited to any particular named manufacturer or other relevant physical limitation (e.g., material).

For the purposes of this description, a form of the invention involving a teddy bear toy holding an illuminated heart will be used, though the present invention applies to alternate embodiments including but not limited to hand puppets and other forms of stuffed animal, as well as alternate shapes like crescent moons or light bulbs.

Figure 1:
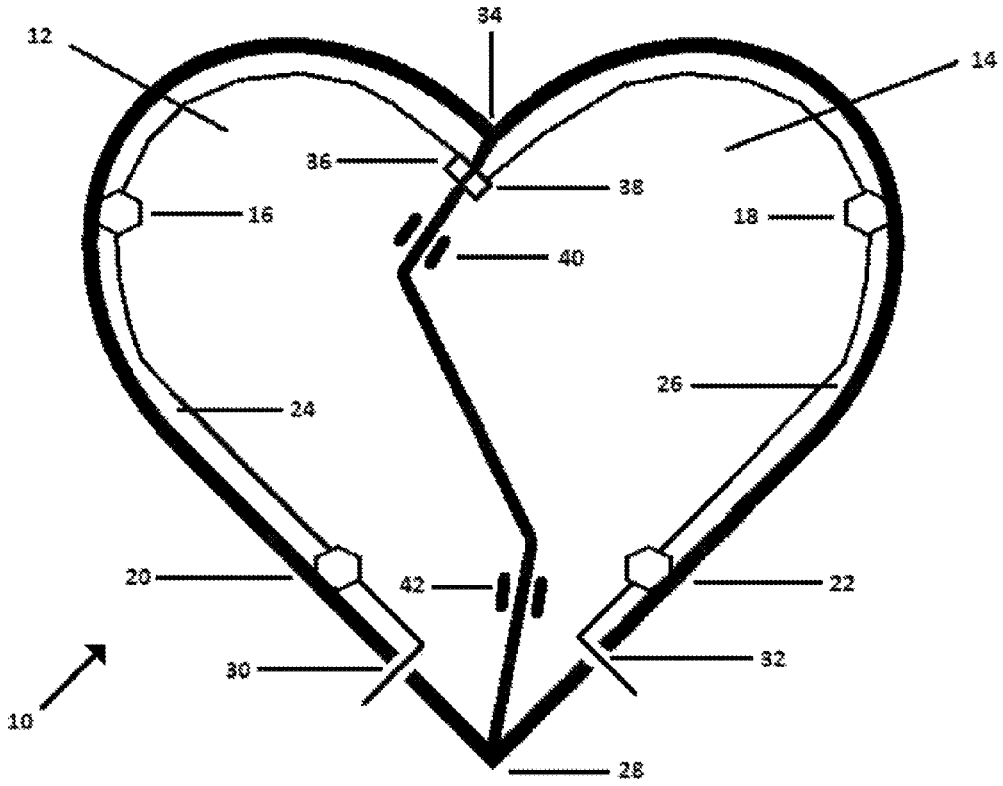
FIG. 1 illustrates a perspective view of an illuminated heart of a teddy bear wired with an electrical circuit, in accordance with some exemplary embodiments of the present invention.

FIGS. 1-5 depict exemplary embodiments of an illuminated heart 10 of a stuffed animal (shown as a teddy bear) wired with an electrical circuit 80. FIG. 1 illustrates a perspective view of the illuminated heart 10, in accordance with some exemplary embodiments of the present invention. The teddy bear toy may be many different sizes and shapes, and preferable, the teddy bear is greater than or equal to six inches in width. The illuminated heart 10, comprising a left heart 12 and a right heart 14, is approximately six inches wide by approximately six inches tall. Within the illuminated heart 10, four LED lights are placed: a top light 16 and a lower light 20 in the left heart 12, a top light 18 and a lower light 22 in the right heart 14. The top light 16 and the top light 18 are on a 0.125 inch wire track 24 along the perimeter of the illuminated heart 10 even with the low crest of the illuminated heart 10, and the lower light 20 and the lower light 22 are placed two inches from heart tip point 28, also along the perimeter of the illuminated heart 10.

A power source 82 for the LED lights is within the teddy bear, supplied through a battery pack wired to contain two "AAA" standard batteries. The electrical wires that power the LED lights within the illuminated heart 10 run from within the teddy bear, through the arms and hands into the illuminated heart 10, via a 0.135 inch hole 30 of the left heart 12 and another 0.135 inch hole 32 of the right heart 14 on outer edge of the illuminated heart 10. There is one pair of copper electrical contacts 34, six millimeters in diameter and 1.5 millimeters thick, connected to these electrical wires that power the LED lights. A first electrical contact 36 and a second electrical contact 38 of the pair of copper electrical contacts 34 are positioned on the interior edge of each half of the illuminated heart 10, so that when the broken heart is joined, the pair of copper electrical contacts 34 is connected.

The connection is maintained without active user attention through an upper set of neodymium magnets 40 and a lower set of neodymium magnets 42 aligned so that, when connected, they will maintain the contact of the pair of copper electrical contacts 34. Both the upper set of neodymium magnets 40 and the lower set of neodymium magnets 42 are approximately six millimeters in diameter and 1.5 millimeters thick, placed on the interior edges of the broken heart halves.

Figure 2:
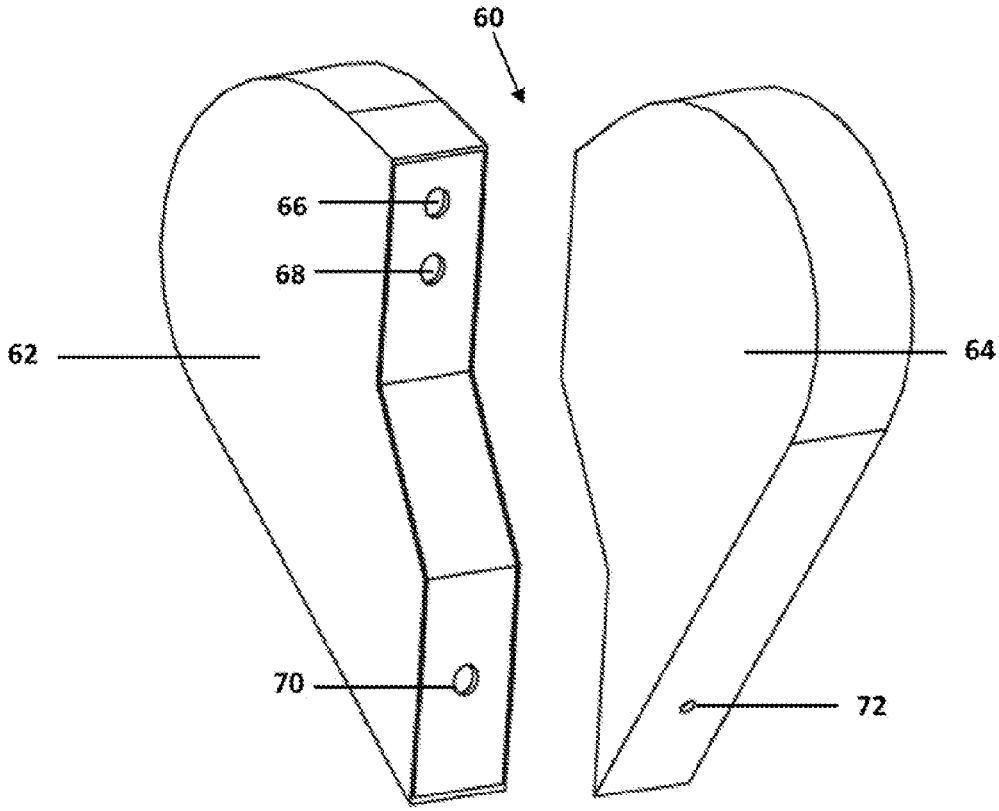
FIG. 2 illustrates a perspective view of a frame of the illuminated heart in an open position, in accordance with some exemplary embodiments of the present invention.
Figure 3:
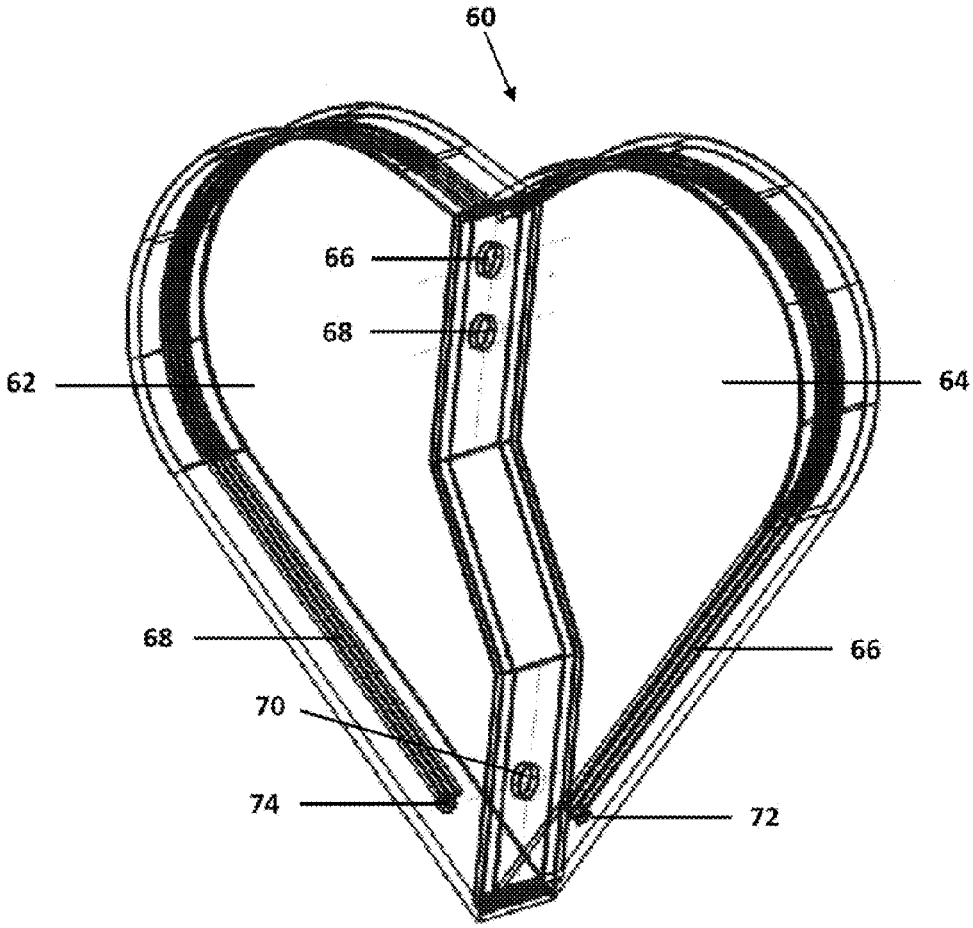
FIG. 3 illustrates a perspective view of the frame of the illuminated heart in a closing position, in accordance with some exemplary embodiments of the present invention.
Figure 4:
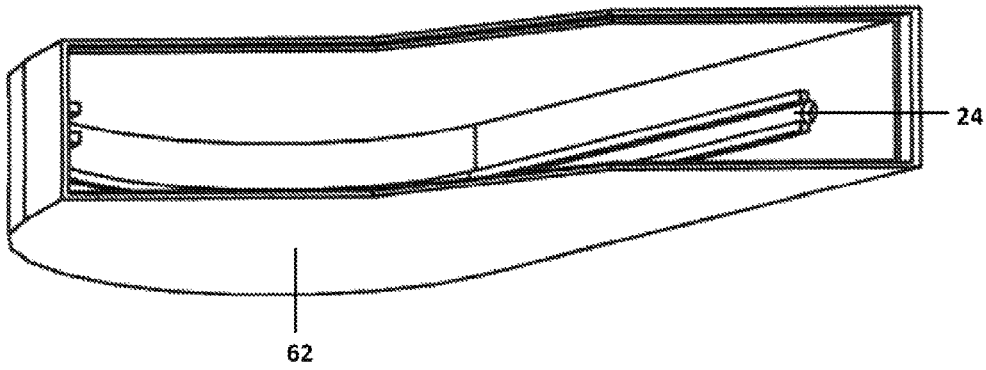
FIG. 4 illustrates a side view of a left part of the frame of the illuminated heart, in accordance with some exemplary embodiments of the present invention.

With reference to FIGS. 2-4, there is depicted a frame 60 of the illuminated heart 10 in accordance with some exemplary embodiments of the present invention. FIG. 2 and FIG. 3 illustrate the frame 60 of the illuminated heart 10 in an open position and a closing position respectively, in accordance with some exemplary embodiments of the present invention. The frame 60 comprises a left part 62 and a right part 64. On the outer edge of each half of the frame 60, there is a 0.135 inch aperture, such as an aperture 74 on the left part 62 and an aperture 72 on the right part 64, via which an incoming wire connects the power source 82 to the electrical wires within the left part 62 or the right part 64 respectively. On the interior edge of each half of the frame 60, there are three apertures of six millimeters in diameter, such as, on the left part 62, an aperture 66 allowing the contact of the pair of copper electrical contacts 34, an aperture 68 allowing the contact of the set of upper neodymium magnets 40, and an aperture 70 allowing the contact of the set of lower neodymium magnets 42, etc.

FIG. 4 illustrates a side view of the left part 62 of the frame 60 of the illuminated heart 10, in accordance with some exemplary embodiments of the present invention. A 0.0125 inch wire track 24 along the inner side of the left part 62 allows the electrical wires of the electrical circuit 80 to pass through the track.

Figure 5:
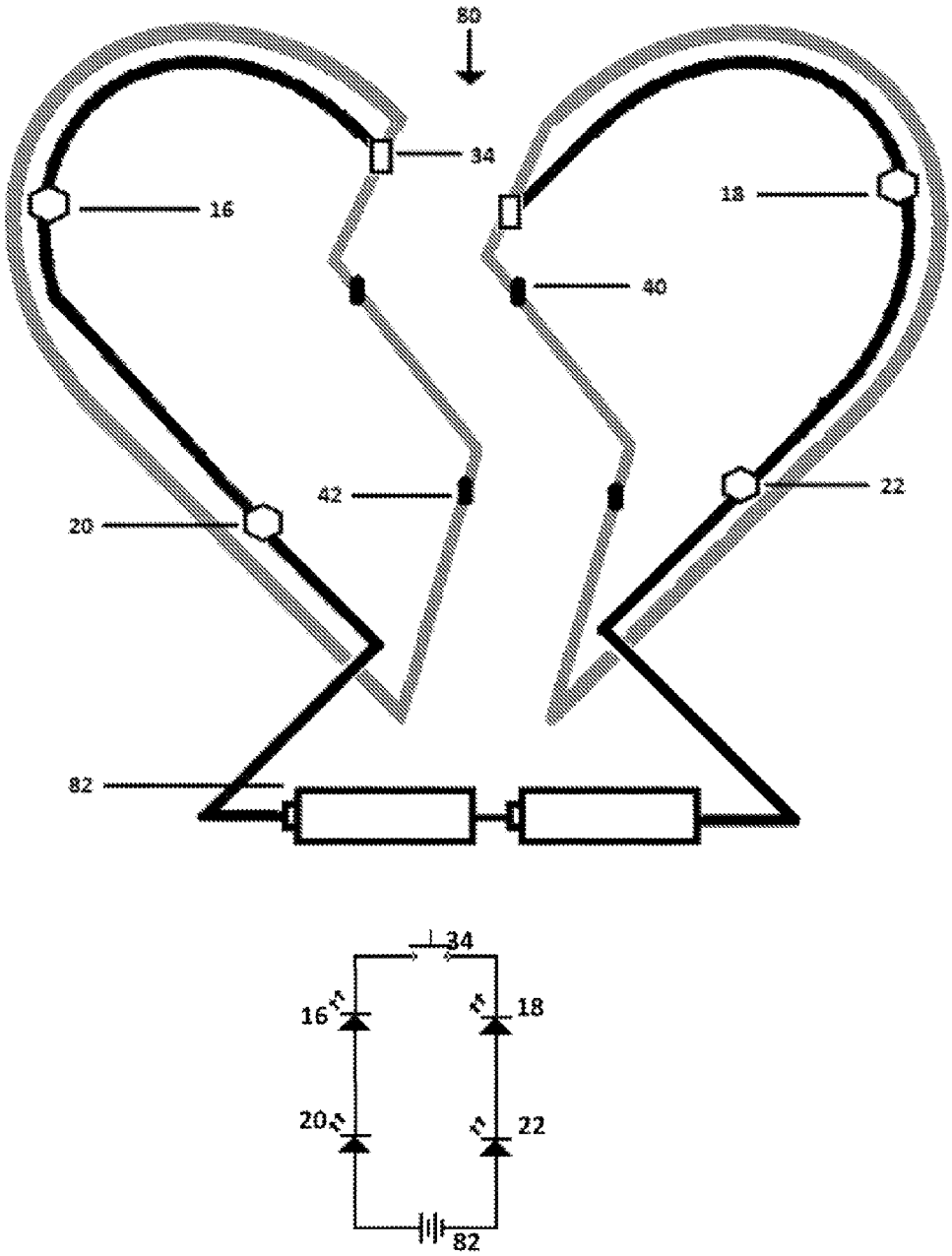
FIG. 5 illustrates a perspective view of the electrical circuit within the teddy bear, and a schematic diagram of the electrical circuit, in accordance with some exemplary embodiments of the present invention.

FIG. 5 illustrates a perspective view of the electrical circuit 80 of the illuminated heart 10, and a schematic diagram of the electrical circuit 80, in accordance with some exemplary embodiments of the present invention. The electrical circuit 80 comprises the power source 82, the upper LED lights 16 and 18, the lower LED lights 20 and 22, the pair of copper electrical contacts 34. In this exemplary embodiment, those four LED lights are connected in series.

Figure 6:
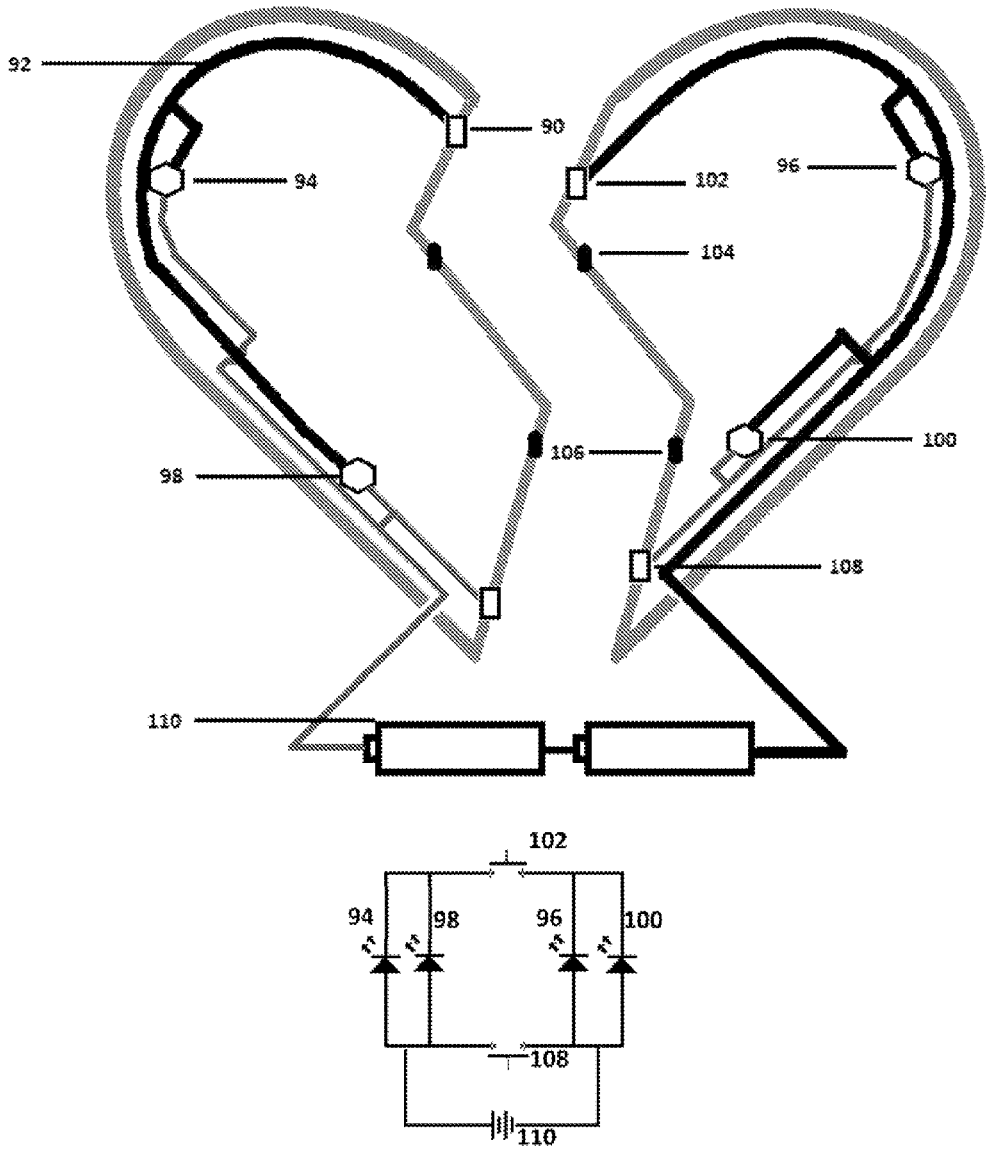
FIG. 6 illustrates a perspective view of another electrical circuit within an teddy bear while a plurality of LED lights in the electrical circuit are connected in parallel, and a schematic diagram of the electrical circuit, in accordance with some exemplary embodiments of the present invention.

FIG. 6 illustrates a perspective view of another electrical circuit 92 of an illuminated heart 90, and a schematic diagram of the electrical circuit 92, in accordance with some exemplary embodiments of the present invention. The electrical circuit 92 includes a power source 110, an upper LED light 94, an upper LED light 96, a lower LED light 98, a lower LED light 100, an upper pair of electrical contact 102, and a lower pair of electrical contact 108. And those four LED lights are connected in parallel. When the broken halves of the illuminated heart 90 are joined, both the upper pair of electrical contact 102 and the lower pair of electrical contact 108 are connected. And the connection is maintained without active user attention through an upper set of neodymium magnets 104 and a lower set of neodymium magnets 106 aligned so that, when connected, they will maintain the contact of the upper pair of electrical contact 102 and the lower pair of electrical contact 108. For the electrical circuit 92, the frame of the illuminated heart 90 will need one more aperture on the interior edge of each half of the frame to allow the contact of the lower electrical contacts 108.

Figure 7:
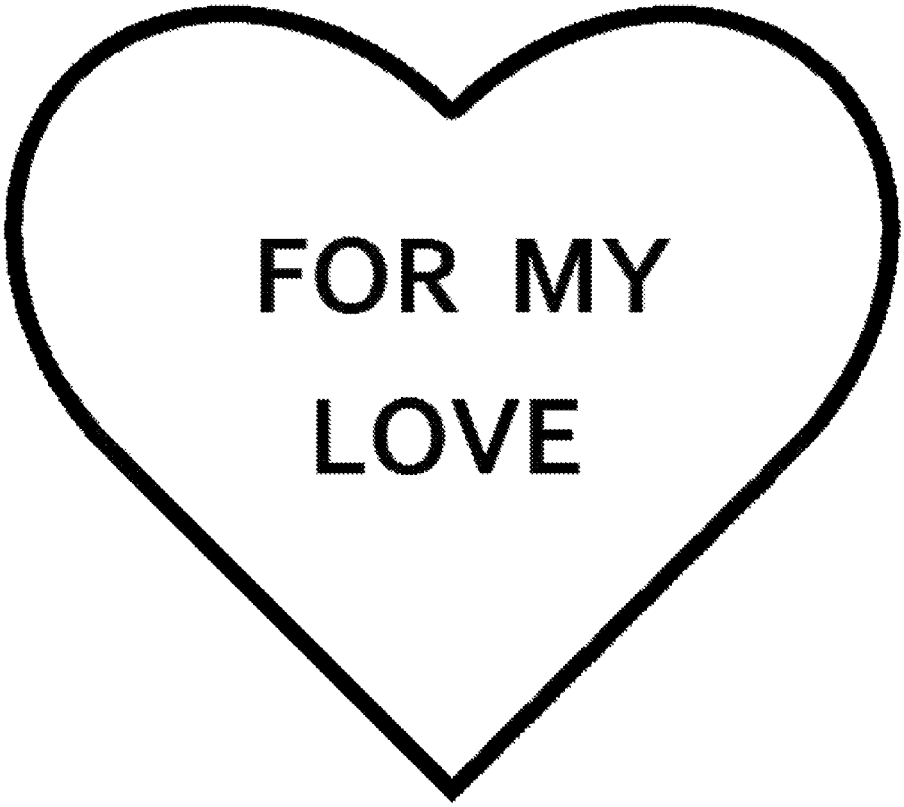
FIG. 7 illustrates an exemplary visual message on an illuminated heart, in accordance with some exemplary embodiments of the present invention.

FIG. 7 illustrates an exemplary visual message 120 on an illuminated heart 121, in accordance with some exemplary embodiments of the present invention. The exemplary visual messages on the illuminated heart 121 may include: "Come Home Soon", "For My Love", etc. According to the exemplary embodiment, letters of the message 120 are hollow and clear with a coloring around them, so the color that the lights would shine through will be visible. For example, the message "For My Love" can be clear with a transparent red coloring surrounding it, and the message "Come Home Soon" can be clear with a transparent cameo or green coloring surrounding it. In alternate exemplary embodiment, the letters of the message 120 may be put on the illuminated heart 121 through clings or removable stickers (not shown). In another exemplary embodiment, the message 120 may be on a sliding and switchable faceplate (not shown). And the faceplate may slide into font fingers of the teddy bear and locks into the bottom of the heart. Furthermore, the faceplate allows the illuminated heart to glow clearly through it. If the faceplate is colored, then the letters of its message glow the color of the light that shines through the clear faceplate. While the invention has been particularly shown and described with references to several exemplary embodiments thereof, it will be understood by those skilled in the art that various changes in form and details may be made therein without departing from the spirit and scope of the invention. For example, the two or more parts of this invention may include a variety of shapes, such as a circle, a square, a star, another geometric shape, and a non-geometric shape. Still further, the electric circuit may be housed and operations within the two or more pieces that are secured to the stuffed animal. Accordingly, if the user removed the mated two or more parts, then the mated parts would remain illuminated and could be separate from the stuffed animal. Still further, the circuitry could be integrated into the body of the stuffed animal with electrical lead lines running internal to the bear that come out of the hands and into the two or more pieces held in the hands. Such a design may be advantageous in better storing a battery operated power source.

What is claimed is:

1. A stuffed animal with an illuminated part, comprising:

the stuffed animal comprising at least one movable member configured for engagement with the illuminated part, the stuffed animal is internally wired with an electrical circuit that leads through the at least one movable member and through at least one or more apertures defined along a lower outer edge of the illuminated part;

the electrical circuit connected to at least one battery power source positioned entirely within the stuffed animal, the illuminated part comprising at least one set of movable components, the at least one set of movable components comprising a first movable component and a second movable component, the first movable component including a first upper LED and a first lower LED and the second movable component including a second upper LED and a second lower LED which are turned on in a circuit closing position and turned off in a circuit open position, the illuminated art illuminated by the upper and lower LEDs positioned along inner sides of the first movable component and the second movable component, the first movable component and the second movable component are completely, separate and distinct from one another, at least one movable component is configured for engagement with the at least one movable member of the stuffed animal to connect or disconnect the first movable component and the second movable component relative to one another;

and at least one pair of electrical contacts comprising a first electrical contact and a second electrical contact, the first electrical contact connected within an aperture of the first movable component, the second electrical contact connected within an aperture of the second movable component;

the first movable component defining one or more apertures for including a first upper magnet and a first lower magnet and the second movable component defining one or more apertures for including a second upper magnet and a second lower magnet thereon for moving from a circuit open position to a circuit closing position by a magnetic force, the at least one pair of electrical contacts and the upper and lower magnets are positioned along interior opposing edges of the first and second movable components;

wherein the first movable component and the second movable component are movable relative to each other and movable from the circuit open position, wherein the at least one pair of electrical contacts is disconnected; and the circuit closing position, wherein the at least one pair of electrical contacts is connected to close the electrical circuit.

2. The stuffed animal of claim 1, wherein the illuminated part further comprises:

the first movable component including at least one electrical wire connected to one side of the at least one battery power source; and the second movable component including at least one electrical wire connected to the other side of the at least one battery power source.

3. The stuffed animal of claim 1, wherein the LEDs are connected in series.

4. The stuffed animal of claim 1, wherein the LEDs are connected in parallel.

5. The stuffed animal of claim 1, wherein the illuminated part further comprises: a message on it, and letters of the message are clear with a coloring surrounding them.

6. The stuffed animal of claim 5, wherein the letters of the message may be put on the illuminated part through clings or removable stickers.

7. The stuffed animal of claim 1, wherein the illuminated part further comprises at least one sliding switchable faceplate with a message, through which the illuminated part glows clearly.

8. The stuffed animal of claim 1, wherein the illuminated part is a heart shape.

9. The stuffed animal of claim 1, wherein at least one movable component is attached to the at least one movable member of the stuffed animal.

10. The stuffed animal of claim 1, wherein the stuffed animal is a teddy bear.

11. The stuffed animal of claim 10, wherein the at least one movable member of the teddy bear is an arm attached to at least one movable component of the illuminated part in the shape of a heart.

* * * * *